US008020480B2

(12) United States Patent
Magner

(10) Patent No.: US 8,020,480 B2
(45) Date of Patent: Sep. 20, 2011

(54) SELF-LUBRICATING ROPES USEFUL IN THE ISOLATION SECTIONS OF OCEAN-BOTTOM CABLES

(75) Inventor: Michael P. Magner, Jefferson, LA (US)

(73) Assignee: ION Geophysical Corporation, Houston, TX (US)

( * ) Notice: Subject to any disclaimer, the term of this patent is extended or adjusted under 35 U.S.C. 154(b) by 326 days.

(21) Appl. No.: 12/060,588

(22) Filed: Apr. 1, 2008

(65) Prior Publication Data

US 2009/0245941 A1 Oct. 1, 2009

(51) Int. Cl.
*D04C 1/12* (2006.01)

(52) U.S. Cl. ..... 87/6; 87/7

(58) Field of Classification Search ..... 87/6, 7, 87/8, 9; 57/210
See application file for complete search history.

(56) References Cited

U.S. PATENT DOCUMENTS

| | | | | |
|---|---|---|---|---|
| 3,791,658 | A * | 2/1974 | Zumeta et al. | 277/537 |
| 4,099,750 | A * | 7/1978 | McGrew | 289/1.5 |
| 4,567,917 | A * | 2/1986 | Millard | 138/126 |
| 4,974,488 | A * | 12/1990 | Spralja | 87/8 |
| 5,494,301 | A | 2/1996 | Hamilton et al. | |
| 5,794,504 | A * | 8/1998 | Starbile | 87/1 |
| 7,047,860 | B2 * | 5/2006 | Faborsky | 87/6 |
| 7,168,231 | B1 * | 1/2007 | Chou et al. | 57/210 |
| 2006/0179812 | A1 * | 8/2006 | Clough et al. | 57/210 |
| 2006/0182962 | A1 * | 8/2006 | Bucher et al. | 428/364 |
| 2006/0207414 | A1 * | 9/2006 | Nye | 87/7 |
| 2007/0079695 | A1 * | 4/2007 | Bucher et al. | 87/8 |
| 2009/0165637 | A1 * | 7/2009 | Bosman et al. | 87/9 |

FOREIGN PATENT DOCUMENTS

| | | | |
|---|---|---|---|
| GB | 1372673 | A | 11/1974 |
| WO | 2004/020732 | A2 | 3/2004 |
| WO | WO 2006133881 | A2 * | 12/2006 |
| WO | WO 2007062803 | A1 * | 6/2007 |

OTHER PUBLICATIONS

W.L. Gore & Associates, Inc., "Gore Valve Stem Packing" brochure, 2007, W.L. Gore & Associates, Inc., Elkton, MD, U.S.A.
Hampidjan, "DYNEX 75" brochure, Hampidjan, Reykjavik, Iceland.

* cited by examiner

*Primary Examiner* — Shaun R Hurley
(74) *Attorney, Agent, or Firm* — James T. Cronvich

(57) ABSTRACT

A rope having an outer jacket made of braided fibers surrounding a PTFE core and a method for making the rope. The rope is useful in high-tension, high-friction applications, such as serving as a stress member in an isolation section of an instrumented ocean-bottom cable. The PTFE core, which may consist of one or more strings of PTFE valve packing material, squeezes through the braided jacket as the rope is deformed in high-stress regions such as around a bollard. The PTFE material squeezed through the outer jacket lubricates the outside of the rope in the high-stress region to lower the friction.

8 Claims, 2 Drawing Sheets

SELF-LUBRICATING ROPES USEFUL IN THE ISOLATION SECTIONS OF OCEAN-BOTTOM CABLES

BACKGROUND

The invention relates generally to high-tension ropes and, more specifically, to stress-member ropes used in head and tail lead-in sections of instrumented ocean-bottom cables.

Ocean-bottom cables (OBC's) instrumented with hydrophones, geophones, accelerometers, and other sensors are used in seismic prospecting, especially in relatively shallow waters. The cables are laid on the sea floor in a pattern over a survey area. The sensors respond to reflections of seismic signals off geologic structures below the sea floor in the survey zone and other seismic disturbances. The OBC's have active sections, in which the sensors reside, separated by isolation sections. The isolation sections dampen acoustic noise and interference that can propagate along the cable. Isolation sections at the ends of the OBC are referred to as lead-in sections. The lead-in isolation sections include two connectors: (a) a nose cone that attaches to a tow or buoy cable; and (b) a housing penetrator that attaches to an active section. A rope runs back and forth between the housing penetrator and the nose cone around bollards on the peripheries of each. The internal isolation sections have a similar rope-bollard arrangement. Using a rope, which compresses, instead of a steel cable, which does not, as a stress member provides acoustic isolation. When the OBC is being deployed or retrieved or when wave action is causing attached buoys to move about, the ropes in the lead-ins especially are subjected to high levels of tension and to torsion about the bollards. Friction caused by the rubbing of the ropes on the bollards can cause the ropes to fray and, unless replaced, eventually to break. Once the rope breaks, that end of the OBC is separated from its buoy or from the cable-laying vessel. In a worst-case scenario, the instrumented OBC is unretrievable and lost.

Thus, there is a need for an OBC lead-in rope that has a longer lifetime.

SUMMARY

That need and other needs may be satisfied by a rope embodying features of the invention including a braided outer jacket of fiber strands surrounding a core of polytetrafluoroethylene (PTFE) material.

Another version of a stress-member rope comprises fiber strands braided to form an outer jacket having a hollow core. A PTFE string resides in the hollow core.

Another aspect of the invention provides a method for increasing the useful life of a braided, multi-strand, hollow-core rope useful in high-tension applications and subjected to rubbing at one or more positions along its length. The method comprises separating the braided strands enough to form an opening from the outside of the rope into its hollow core and then threading one or more strands of PTFE string through the opening and along the hollow core.

In yet another aspect of the invention, an isolation section of an OBC comprises a first connector and a second connector spaced apart from the first. Each connector has bollards on its periphery. A rope having loops at opposite ends is looped around first and second bollards on the first connector. The rope runs back and forth between the two connectors and is guided around other of the bollards on the peripheries of the connectors. The rope includes a braided outer jacket of multiple strands surrounding a hollow core in which a string of PTFE material resides.

BRIEF DESCRIPTION OF THE DRAWINGS

These features and aspects of the invention, as well as its advantages, are better understood by reference to the following description and claims and accompanying drawings, in which:

DETAILED DESCRIPTION

Figure 1:
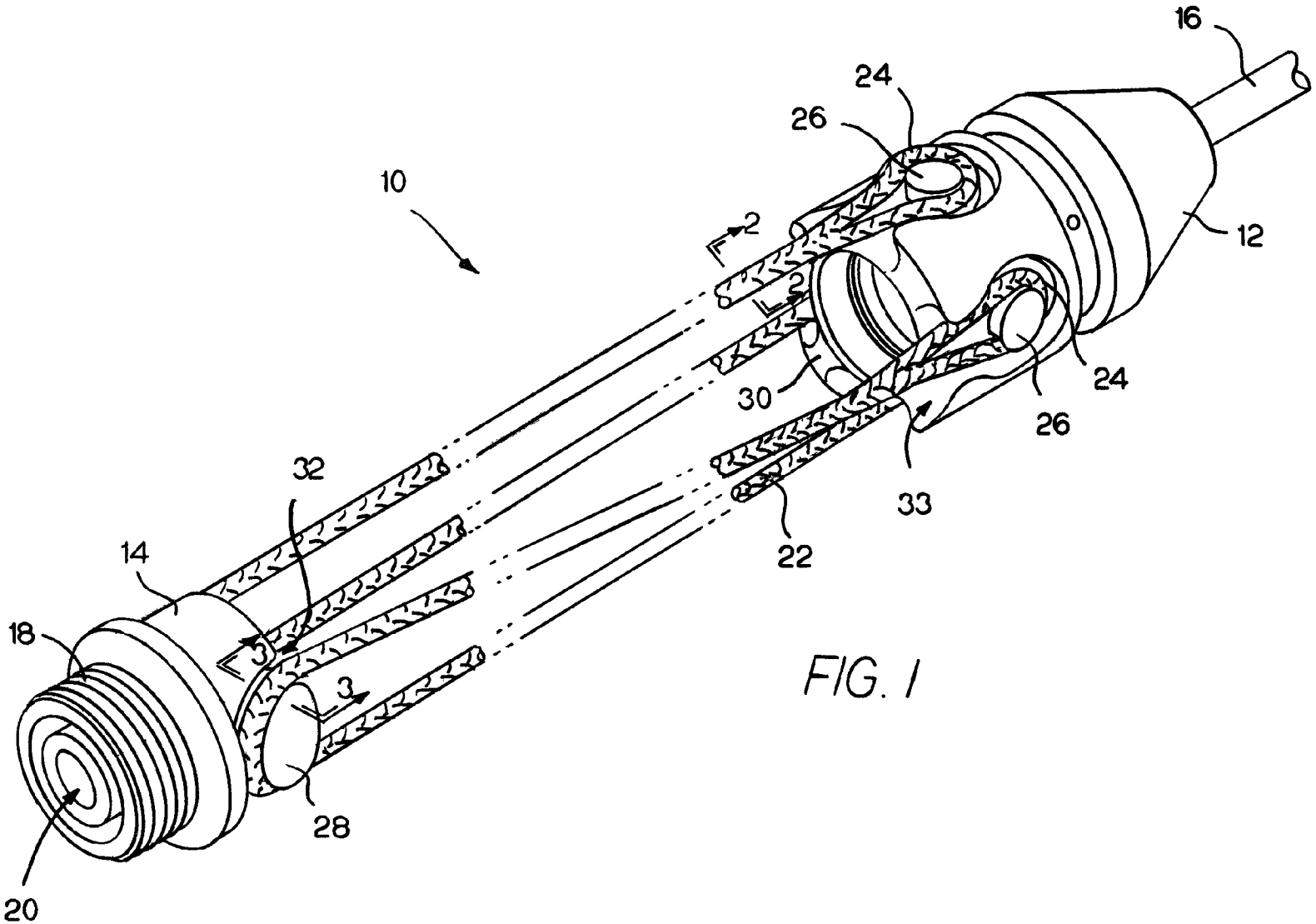
FIG. 1 is an isometric view of a lead-in section of an OBC with a stress-member rope embodying features of the invention.

A lead-in acoustic isolation section embodying features of the invention is shown in FIG. 1. The lead-in section 10, which is used at either or both ends of an OBC, includes two connectors: a nose cone connector 12 and a housing penetrator 14 at opposite ends of the section. A cable 16 from a buoy or a cable-handling vessel is terminated in the nose cone. The cable includes stress members, such as steel cables, and electric power and signal wires. The power and signal wires are routed through the lead-in section in an electrical cable (not shown) to the penetrator and into the OBC, which attaches to the penetrator at a flanged, sealed connection 18 having a bore 20 for the electrical cable. Acoustic isolation sections interposed between active OBC sections also have similar connectors at each end. The two connectors are linked by a stress-member rope 22. Loops 24 at opposite ends of the rope are hooked on small bollards 26 on the nose cone. The rope passes around bollards 28 on opposite sides of the periphery of the penetrator and a large bollard 30 on the periphery of the nose cone. Grooves 32, 33 recessed inward from the peripheries of the two connectors receive the rope and allow the bollards to be flush with the connectors' peripheries.

The rope serves as a stress member bearing the tension in the OBC. Surges and other variations in the tension that occur as the OBC is deployed and retrieved or by wave action on a buoy attached to the lead-in sections cause the rope to rub on the sides of the bollards. The tension also causes the ropes to deform or flatten around the bollards. Thus, the bollards exert high stresses on the portions of the rope they frictionally contact.

Figure 3:
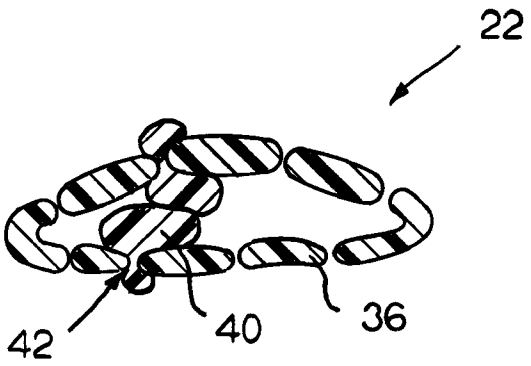
FIG. 3 is an enlarged cross-section of the rope wrapped around a bollard taken along lines 3-3 of FIG. 1.
Figure 2:
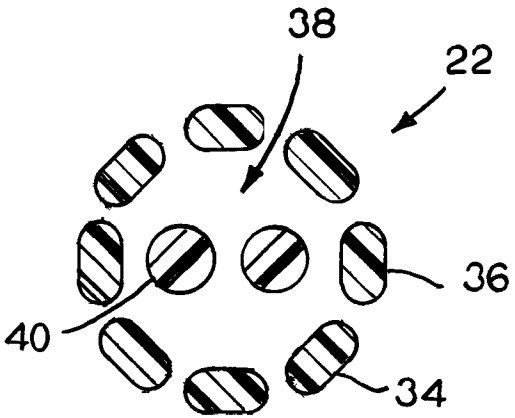
FIG. 2 is an enlarged cross-section of the rope of FIG. 1 taken along lines 2-2.

The rope 22, as shown in FIG. 2, is constructed of an outer jacket 34 of braided fiber strands 36 surrounding a hollow interior, or core 38. For high-tension applications, the strands are made of a high-strength material, such as DYNEEMA® fibers. One or more lengths or strands 40 of a lubricious material, such as polytetrafluoroethylene (PTFE), reside in the hollow interior of the jacket to form the rope's core. When the rope is under tension, it deforms, especially where it contacts a bollard. When the rope is pulled taut around a bollard, its cross section compresses as shown in FIG. 3. The outer jacket squashes the PTFE strands 40, squeezing PTFE material from the strands through voids 42 between the braided fiber strands of the jacket to the outside of the rope jacket and against the bollard to lubricate the contact area and reduce the friction. Thus, the PTFE-core rope is self-lubricating.

Figure 4:
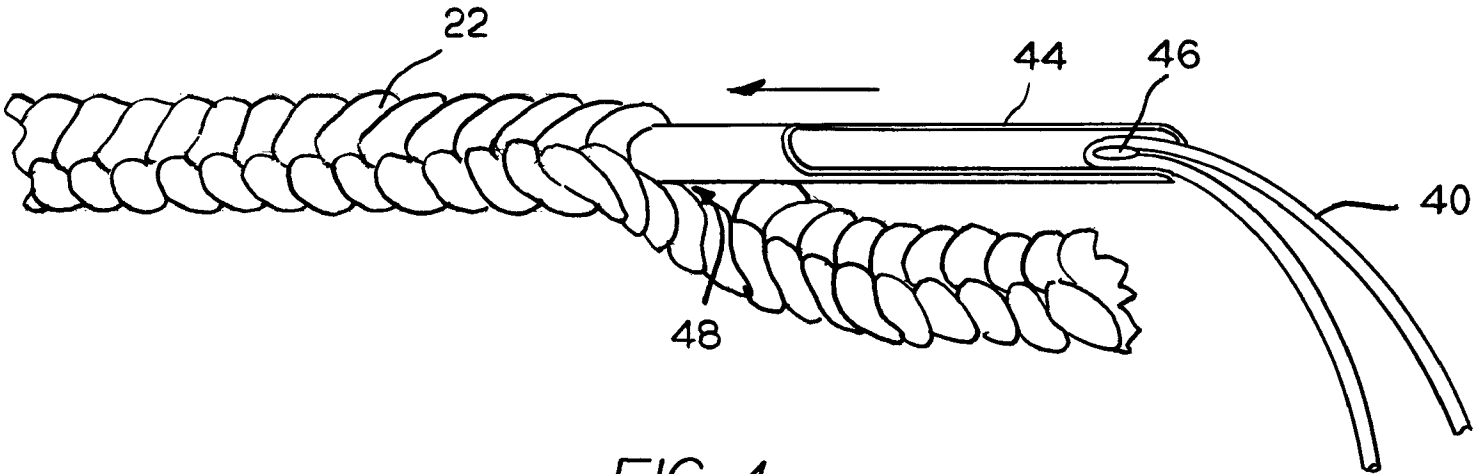
FIG. 4 is an illustration of a method for inserting a TPFE string into a high-tension rope used in an OBC lead-in section as in FIG. 1.

A standard high-tension rope can be made self-lubricating according to the invention by a method depicted in FIG. 4. A PTFE string 40, such as a string of valve stem packing available, for example, from W.L. Gore & Associates, Inc. of Elkton, Md., U.S.A., is inserted into the hollow core of a standard high-tension rope 22 with a fid 44. The untensioned rope is first axially compressed enough to separate the braided strands in the jacket to reveal an opening 48 into the hollow interior. The PTFE string is looped around a hook 46 on the fid. The fid is inserted through the opening and into the interior of the rope's jacket and pushed along the interior with the doubled-over PTFE string in tow. At the other end of the rope, the fid is pushed through an opening in the braided outer jacket to exit the rope. The PTFE string, which is threaded through the rope and forms its core, is then separated from the fid. In this way, the rope can be made self-lubricating. Because the PTFE string extends the length of the rope, it is available to lubricate the entire length of the rope. The amount of lubrication can be set by the number of strands passing through the core of the rope or their diameters. The supply of PTFE material to high-stress regions of the rope reduces the friction and increases the life of the rope.

Although the rope of the invention has been described with respect to a specific industrial application, it may be used as well in other high-tension or high-friction applications.

What is claimed is:

1. A stress-member rope for use in an ocean-bottom cable isolation section, the rope comprising:

fiber strands made of a high tensile strength material devoid of PTFE and braided to form an outer jacket surrounding a hollow interior core; and a PTFE string residing in the hollow interior core.

2. A stress-member rope as in claim 1 wherein the outer jacket is made of DYNEEMA® fibers.

3. A stress-member rope as in claim 1 wherein the PTFE string extends the length of the rope.

4. A stress-member rope as in claim 1 wherein the PTFE string makes more than one pass through the hollow interior core.

5. A stress-member rope as in claim 1 wherein the PTFE string fills the hollow interior core sufficiently so that tension in the rope that causes the rope to deform and the hollow interior core to shrink at a rubbing position along the rope's length forces material from the PTFE string in the hollow interior core through spaces between the braided strands in the outer jacket to lubricate the rope at the rubbing position.

6. An isolation section of an ocean-bottom cable, comprising:

a first connector having bollards on its periphery;

a second connector spaced apart from the first connector and having bollards on its periphery;

a rope having loops at opposite ends looped around first and second bollards on the periphery of the first connector, the rope running back and forth between the first connector and the second connector and guided around other of the bollards on the peripheries of the first and second connectors;

wherein the rope includes a braided outer jacket of multiple strands made of a high tensile strength material devoid of PTFE surrounding a hollow interior core and a string of PTFE material residing in the hollow interior core.

7. An isolation section as in claim 6 wherein the amount of PTFE material in the hollow interior core is sufficient so that tension causing the rope to deform and the hollow interior core to shrink at the bollards forces the PTFE material in the string from the core through spaces between the braided strands in the outer jacket to lubricate the rope at the bollards.

8. An isolation section as in claim 6 wherein the string of PTFE material extends the length of the rope.

* * * * *